US006736198B2

(12) United States Patent
Zhu et al.

(10) Patent No.: US 6,736,198 B2
(45) Date of Patent: May 18, 2004

(54) ASSEMBLING HEAT EXCHANGER OF SPIRAL SLEEVE

(76) Inventors: Yanwen Zhu, Room 909, Huibin Building, No. 8 Beichendong Street, Chao Yang District, Beijing 100101 (CN); Zhigui Ma, Room 909, Huibin Building, No. 8 Beichendong Street, Chao Yang District, Beijing 100101 (CN)

( * ) Notice: Subject to any disclaimer, the term of this patent is extended or adjusted under 35 U.S.C. 154(b) by 0 days.

(21) Appl. No.: 10/202,685

(22) Filed: Jul. 22, 2002

(65) Prior Publication Data

US 2002/0179292 A1 Dec. 5, 2002

Related U.S. Application Data

(63) Continuation of application No. PCT/CN01/00014, filed on Jan. 10, 2001.

(30) Foreign Application Priority Data

Jan. 26, 2000 (CN) ..... 00201305 U

(51) Int. Cl.[7] ..... F28D 7/10
(52) U.S. Cl. ..... 165/156; 165/163
(58) Field of Search ..... 165/156, 163

(56) References Cited

U.S. PATENT DOCUMENTS 4,231,425 A * 11/1980 Engstrom ..... 165/156
4,559,999 A * 12/1985 Servas et al. ..... 165/156
4,858,584 A * 8/1989 Bridgeman ..... 123/557
5,309,987 A * 5/1994 Carlson ..... 165/159
5,379,832 A * 1/1995 Dempsey ..... 165/110
5,487,423 A * 1/1996 Romero ..... 165/156

* cited by examiner

*Primary Examiner*—Allen Flanigan
(74) *Attorney, Agent, or Firm*—Fish & Richardson P.C.

(57) ABSTRACT

A heat exchanger consists of an outer casing, core tube device, flow guide plate and sealing means. The outer casing comprising the lower and upper outer casings has the front and rear enclosed plates fixed to both ends to form a closed casing. The core tube device provided at the middle portion of the outer casing includes a core tube body, end enclosed plates and heat exchanging copper tubes. The flow guide plate is located between the inner wall of the outer casing and the outer wall of the core tube body with the sealing means provided between the upper and lower outer casings and secured into an integral casing by bolts and nuts. The exhausted hot water enters the heat exchanger from the inlet on the outer casing and exits the outlet while the clean tap water enters the heat exchanger from the opposite inlet provided on the core tube device. The hot water absorbing the heat from the exhausted hot water exits the outlet, thus giving full recovery of the heat stored in the exhausted hot water, energy savings and ease of manufacturing and cleaning.

6 Claims, 10 Drawing Sheets

E – E

ASSEMBLING HEAT EXCHANGER OF SPIRAL SLEEVE

CROSS REFERENCE TO RELATED APPLICATIONS

This application is a continuation, and claims under 35 USC 120, the benefit of priority of International Application No. PCT/CN01/00014, filed Jan. 10, 2001 which claims priority from China Application No. 00201305.3, filed Jan. 26, 2002. The disclosure of the prior applications is considered part of, and is incorporated by reference in, the disclosure of this application.

TECHNICAL FIELD

The invention relates generally to the engineering heat exchanger in a fluid heater with a heat source. In particular, it relates to a heat exchanger capable of full recovery of the thermal remainder from the exhausted hot water.

BACKGROUND ART

The existing practical heat exchanger providing effect of heat exchanger has some drawbacks in structure which makes impossible the optimization of its application. The main drawback is the low efficiency of heat exchange, complexity of structure, difficulty in manufacturing and cleaning in the case of heat exchange with reduced temperature difference (3° C.~5° C.). Especially there is no recovery of the thermal remainder from the bating exhausted water, or low recovery efficiency which causes waste of thermal resource. Furthermore, it is important for the user to clean the heat exchanger, and the existing one cannot meet the demand, thus there is a need to improve the existing heat exchanger.

DISCLOSURE OF THE INVENTION

In view of the drawbacks of the existing heat exchanger, the inventor has developed the invention based on the practical experience and expertise as well as constant research and improvement of the model.

The object of the invention is to overcome the problems of existing heat exchanger, thus to provide a new assembling heat exchanger of spiral sleeve which is able of recovery of the thermal remainder of the exhausted hot water from families, public baths or other places with relatively high efficiency of heat exchange, ability of increasing the temperature of tap water corresponding to the amount of the exhausted hot water, saving of energy and reducing cost.

The another object of the invention is to provide a new assembling heat exchanger of spiral sleeve which is compact in structure, easy to assemble, detach and clean.

The objects of the invention can be achieved by the following technique. According to the invention and assembling heat exchanger of spiral sleeve including the outer casing and core tube device is characterized in that it mainly consists of the outer casing, enclosed plate, core tube device, flow guide plate and sealing means; in which:

The above outer casing is designed as an integral casing structure, or an integral casing structure combined by the lower and upper outer casings;

The above enclosed plate has its front plate sealed with the front end of the outer casing and its rear plate sealed with the rear end of the outer casing; the outer casing and the enclosed plate are sealed to form a closed casing;

The above core tube device provided in the middle portion of the outer casing comprises the core tube body, and enclosed plates and heat exchanging copper tube;

The above flow guide plate provided between the inner wall of the outer casing and the outer wall of the core tube body has its inner annular surface contacted the core tube body and its outer annular surface contacted the inner surface of the outer casing;

The above sealing means is sandwiched between the lower and upper outer casings which are formed into an integral outer casing by fasteners.

The object of the invention can be achieved further by the following technique. The assembling heat exchanger of spiral sleeve according to claim 1 is characterized in that the outer casing is designed to have an accomudating channel chamber with some geometrical shape section which may be a circular channel, a rectangular channel or the combination of both.

In the above mentioned assembling heat exchanger of spiral sleeve the above lower outer casing being a downward concave casing has the lid provided on two sides, and the sealing means provided between the lower and upper outer casings which are then sealed and formed into an integral outer casing;

The above upper outer casing being an upward concave casing has lids on two sides and fasteners inserted through the lids to joint the upper and lower outer casings into an integral outer casing; furthermore, a vent port and the inlet of thermal medium are formed on the top of the upper outer casing;

The above front enclosed plate is provided at the front end of the outer casing with an outlet of thermal medium provided on the upper portion of the center line extending outward and a circular hole for the parallel joint at the upper portion of the front plate;

The above rear enclosed plate is provided at the rear end of the outer casing and sealed with it, also a circular hole for the parallel joint is provided on the lower portion of its center line;

The above core tube device has its core tube body formed as a hollow tube and positioning ridges provided on the outer surface, also the heat exchanging copper tube wound around it; the semiannular flow guide plate is placed between the adjacent copper tubes; the section shape of the core tube body is corresponding to that of the outer casing;

The above end enclosed plates are fixed to the edges of two inner holes of the core tube body respectively;

The heat exchanging copper tube is wound between the inner wall of the outer casing and the outer wall of core tube body with two parallel joints provided on both ends in which one parallel joint sealingly fixed with the hole in front enclosed plate and the other with the hole in rear enclosed plate;

The above flow guide plate provided between two adjacent heat exchanging copper tubes which are positioned in opposite directions are shaped in correspondance with the half section shape of the outer casing;

The sealing pad of the above sealing means is sandwiched between the lower and upper outer casings which are then secured and sealed in a complete sealed outer casing by inserting the fastening bolts into the lids of the lower and upper outer casing and fixing by nuts.

In the above mentioned assembling heat exchanger of spiral sleeve the section shape of the lower outer casing may be semicircular concave, semirectangular concave or the combination of both;

The vent port and inlet of the thermal medium provided on top of the upper outer casing may be formed integral with the upper outer casing, or separate which are then integrated with the upper outer casing;

The outlet of the thermal medium provided on the front enclosed plate may be the structure formed integral with the front plate or separate which are then integrated with it;

The above rear enclosed plate is bonded integrally with the lower and upper outer casings by adhesive;

The section shape of the core tube body may be circular, rectangular or the combination of both;

The end enclosed plates are fixed with the edges of two and inner holes of the core tube body by adhesive;

The heat exchanging copper tube is coated with isolating paint on the outer surface.

In the above mentioned assembling heat exchanger of spiral sleeve, there are one or more heat exchanging copper tubes; the flow guide plate with the semicircle shapes section has a positioning slot provided on one side of the inner hole by means of which the flow guide plate is secured on the positioning ridges of the core tube body integrally;

In the case of a single heat exchanging copper tube, the parallel joint is integrated with the heat exchanging copper tube;

In the case that a plurality of heat exchanging copper tubes are wound in parallel to form an assembly of copper tubes, the parallel joints are designed with a end of circular tube fitted with the hole of outer casing, and the other end of flat tube welded integrally with the circular tube; the flat tube is divided into a number of circular holes into which a plurality of heat exchanging copper tubes are inserted forming the assembly of heat exchanging copper tubes.

In the above mentioned assembling heat exchanger of spiral sleeve the vent port on top of the upper outer casing is 6~8 mm circular hole in diameter, and the inlet of thermal medium is a 25~40 mm circular hole in diameter; the lower and upper outer casings are made of engineering plastics;

The outlet of the thermal medium provided in the front enclosed plate is a 25~40 mm circular hole in diameter with the diameter of the hole for parallel joint on the upper side equal to the diameter of the parallel joint which are snap fitted;

The end enclosed plates can be designed as the outer cover plate secured to outer sides of two ends of the core tube body by bolts;

The heat exchanging copper tube is a thin copper tube with diameter of 5~10 mm, distance between its outer wall and the inner wall of the outer casing as well as the outer wall of the core tube body is 3~5 mm.

In the above mentioned heat exchanger of spiral sleeve, the outer casing posses at least more than two heat exchange units of spiral sleeves connected by elbows into a integral tubular net structure.

In the above mentioned heat exchanger of spiral sleeve, the heat exchange unit of spiral sleeve consisiting of outer casing core tube body, heat exchanging copper tube and flow guide plate with the outer casing as a circular tube of certain length has the connecting elbows on the end portions which are positioned between the rear end of the outer casing and the heat end of the next outer casing jointing a number of heat exchange units of spiral sleeves into an integral tubular net structure;

The front and rear enclosed plates of the core tube device are provided only on the first inlet end and the last outer end of the whole tubular net structure and are connected with the outer casing integrally;

The vent port and inlet of the thermal medium are provided on the first outer casing of the tubular net structure with the parallel joint on the end portion, an the outlet the thermal medium is provided on the last outer casing with the parallel joint on the end portion.

In the above mentioned heat exchanger of spiral sleeve, the above outer casing comprising the spiral lower outer casing and upper outer casing has the sealing pad placed between the spiral lower outer casing and upper outer casing which form a spiral channel with circle shaped section; inside the spiral channel a core tube body is provided around which the thin heat exchanging copper tube is wound; and a semicircular flow guide plate is provided between the adjacent two heat exchanging copper tubes which are positioned in opposite directions;

The vent port and inlet of the thermal medium are formed on the above upper outer casing which are wounded integrally with the upper outer casing; the integral spiral channel formed by the semicircular spiral channels is moulded on the lower and upper outer casings;

The above core tube device is spiral tube with end enclosed plates fixed to two ends of the core tube body to form an integral core tube device.

In the above mentioned heat exchanger of spiral sleeve, there are one or more thin copper tubes of diameter of 5~10 mm wound around the core tube body and the parallel joints are connected to both ends of the thin copper tubes with the outlet of which connect to the gas water heater or electric water heater, or the integral bath room.

In the above mentioned heat exchanger of spiral sleeve, the said outer casing is a spiral outer casing without end enclosed plates and the sealing means is provided between the spiral lower outer casing and the upper outer casing which are then jointed into an integral outer casing with an interior sealed spiral channel by a number of fastening bolts; the longitudinal section of the core tube body and the heat exchanging copper tube are waveform shaped.

In the above mentioned heat exchanger of spiral sleeve, the said outer casing comprises the lower and upper outer casing, in which the shape of the cross section of the lower outer casing is semicircular down-ward concave with that of the longitudinal section waveform shaped;

The shape of the cross section of the upper outer casing is semicircular upward concave with the longitudinal section waveform shaped; the vent port is provided on the top of the upper casing, and the inlet and outlet of the thermal medium also the cold water inlet and outlet formed my the threaded holes for the parallel joints are formed on the top of head end of the interior ring and the top of the rear and of the exterior ring respectively;

The above core tube body is a hollow tube with its cross section circle shaped and its longitudinal section waveform shaped;

The above sealing means includes the fastening bolts, nuts and sealing pad.

In the above mentioned heat exchanger of spiral sleeve, the sealing pad of the sold sealing means is sandwiched between the lower and upper outer casings which are then connected into a complete outer casing with an interior circular sealed spiral channel by inserting the fastening bolts into the holes provided on the lids of the lower and upper outer casing and then securing by the nuts.

In the above mentioned heat exchanger of spiral sleeve, the highness between the peaks and valleies of the wave of the said lower and upper outer casings is 1~5 mm, and the distance between the peaks or valleies is 20~60 mm, the water outlet is connected to the gas water heater or electric water heater, or the integral bath room.

BRIEF DISCRIPTION OF THE DRAWINGS

BEST MADE OF EMBODIMENT OF THE INVENTION

Figure 1:
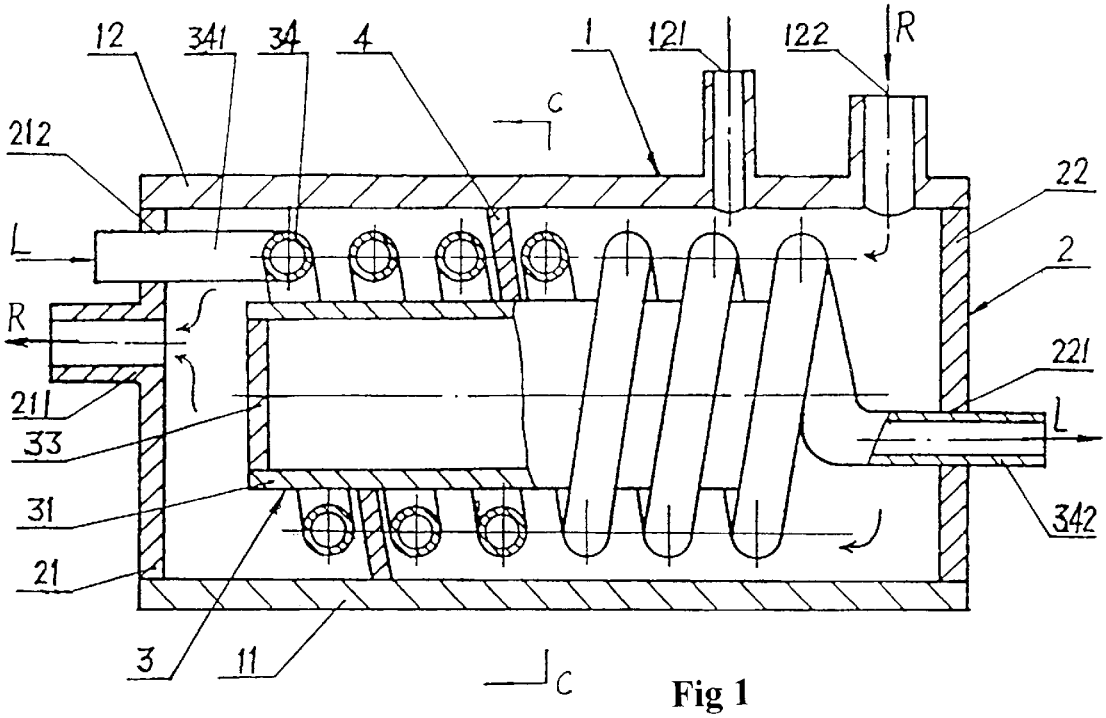
FIG. 1 is the sectional view of the combination structure of the invention.
Figure 2:
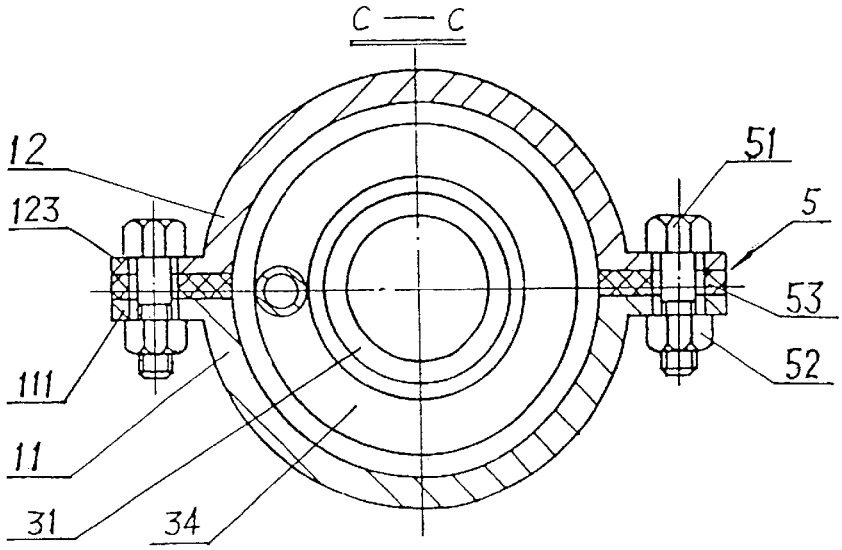
FIG. 2 is the sectional view taken along C—C line in FIG. 1.
Figure 3:
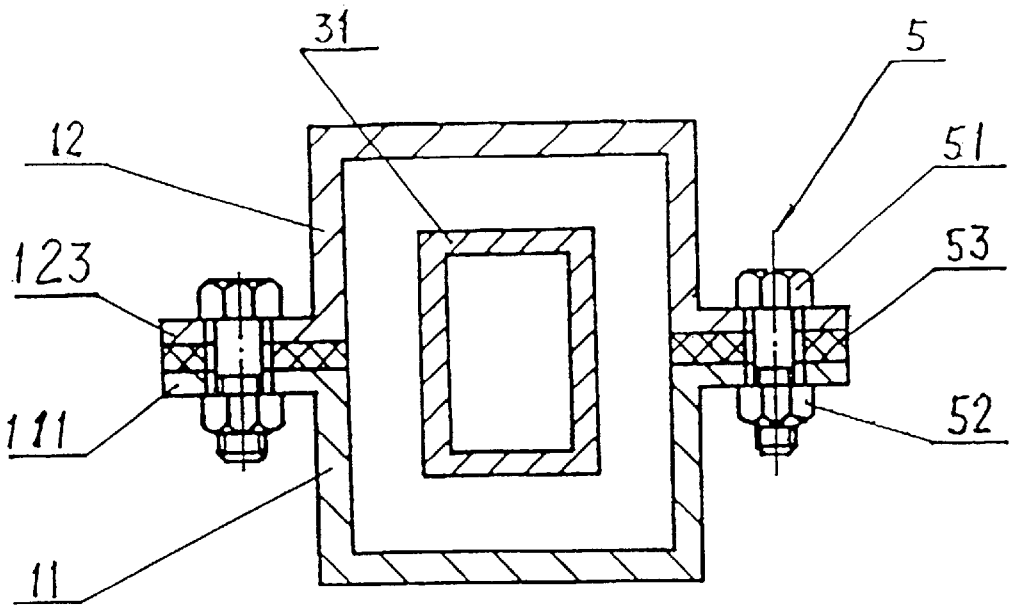
FIG. 3 is the schematically sectional view of the outer casing of the invention.

Next the invention will be described in detail by way of preferred embodiments with reference to the drawings.

Figure 4:
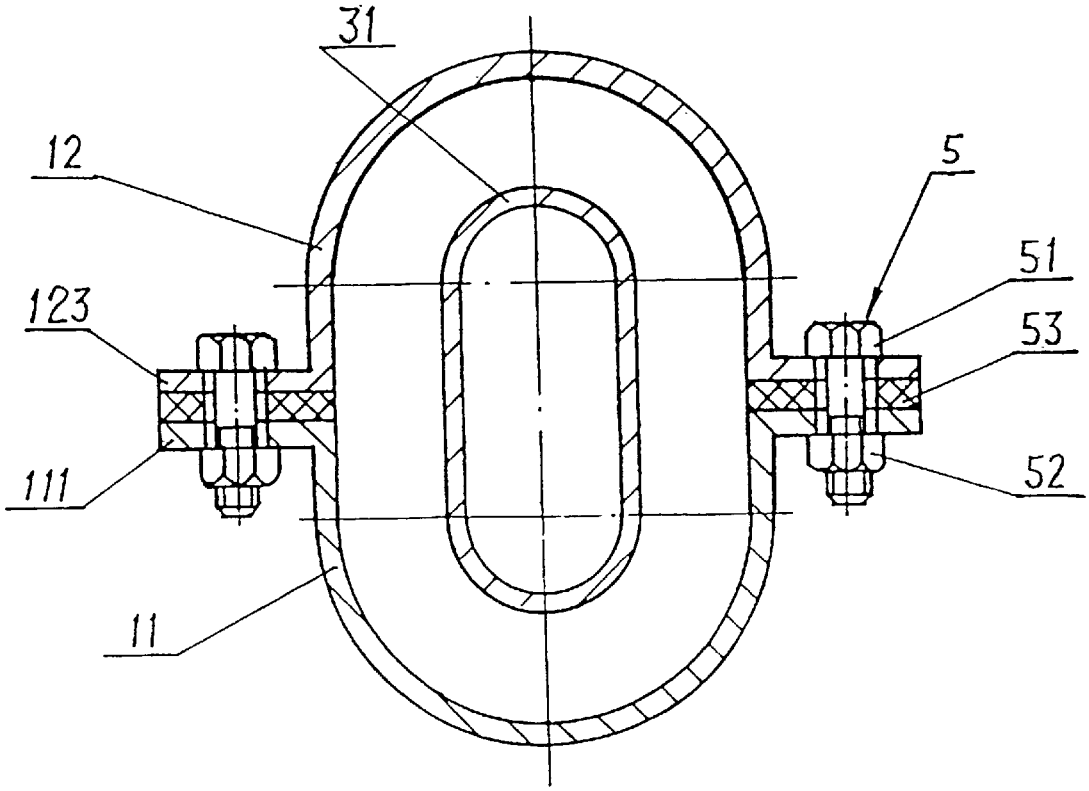
FIG. 4 is another schematically sectional view of the outer casing of the invention.

Referring to FIGS. 1, 2, 3 and 4, the assembling heat exchanger of spiral sleeve is comprising an outer casing 1, enclosed plate 2, core tube device 3, flow guide plate 4 and sealing means 5; in which:

The above outer casing 1 includes a lower outer casing 11 and an upper outer casing 12, wherein:

The outer casing 1 is designed as an accomudating chamber with the section of suitable geometric shape. The section of the outer casing 1 may be a circular channel (FIG. 2), rectangular channel (FIG. 3) and the combination of circular and rectangular channel (FIG. 4).

The lower outer casing 11 which has its section shaped as semicircular concave body (FIG. 2), semirectangular body (FIG. 3) or the combination of both semicircular and semirectangular bodies is formed of a downward concave body with lids 111 provided at both sides respectively. A sealing means 5 connected integrally with the outer casing 1 is provided between the lower outer casing 11 and the upper outer casing 12 at the engaged portion thereof.

The upper outer casing 12 is formed of upward concave body with lids 123 provided at both sides respectively. A bolt 51 and nut 52 passing through the lids 123 and the lids 111 of lower outer casing 11 joint the upper outer casing 12 and the lower one 11 to form the integral outer casing 5. A vent port 121 and inlet of thermal medium 122 which are integrated with the upper outer casing 12 by means of insection moulding are provided on top of the upper outer casing 12. The vent port 121 is a circular hole with diameter of 6~8 mm, and the inlet of thermal medium 122 is a Φ25~40 mm circular hole in diameter. The lower and upper outer casings 11 and 12 are made of engineering plastics.

The above mentioned enclosed plate 2 includes a front plate 21 and a rear plate 22 wherein:

The front enclosed plate 21 provided at the front and of the outer casing 1 has the upper part of its outer line extended outward with an outlet of the thermal medium 211 thereon. The outlet of the thermal medium 211 being a Φ25~40 mm circular hole in diameter is moulded integrally with the front enclosed plate 21, and a circular hole 212 for passing through of the parallel joint 341 is formed on the upper side of the front plate. The circular hole 212 and the parallel joint 341 are snap fitted with their diameters equaled to each other.

The rear enclosed plate 22 provided at rear end of the outer casing 1 is bonded to the lower and upper outer casings 11, 12 by adhesive. The shape of the rear plate 22 is corresponding to sectional shape of the outer casing 1, and at the lower position under the center line a circular hole 221 having its diamater equaled to that of the parallel joint 342 and snap fitted with the latter for passing through the parallel joint 342 is provided.

Figure 5:
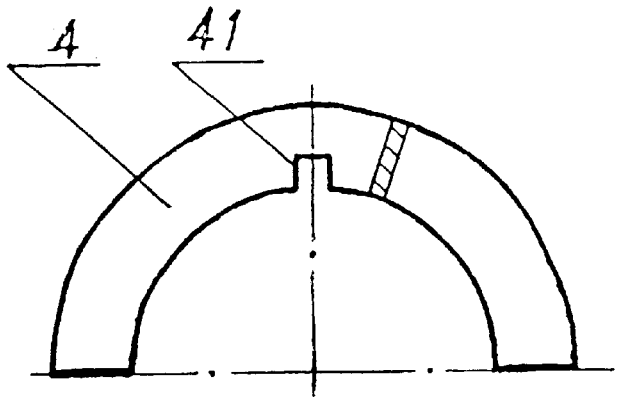
FIG. 5 is the schematic view of the structure of the flow guide plate of the invention.
Figure 6:
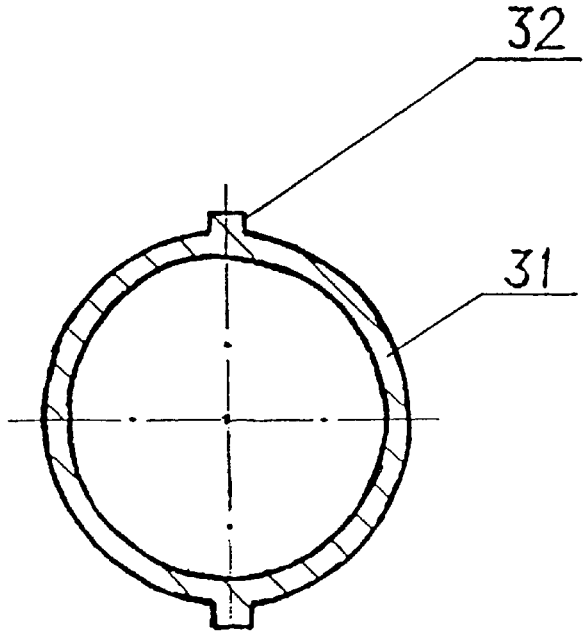
FIG. 6 is the schematic view of the structure of the core tube body of the invention.

The core type device 3 including a core tube body 31, end close plate 33 and heat exchanging copper tube 34 is provided at the middle portion of the outer casing 1, wherein:

Being a hollow tube the core tube body 31 has integrally moulded positioning ridges 32 at its outer suface (FIG. 6). The heat exchanging copper tube 34 is wound around the outer suface of the core tube body 31, and a semiannular flow guide plate 4 is provided between the adjacent two copper tubes for heat exchange 34 (see FIG. 5 too). The shape of the section of the core tube body 31 which is corresponding to that of the outer casing 1 may be circular (FIG. 2), rectangular (FIG. 3) or combination of both (FIG. 4).

The end plates 33 fixed to both ends of the core tube body 31 are bonded and sealed to the edges of two holes of the core tube body 31 by means of adhesive. The end plates 33 may also be designed as an outer cover plates which are then secured to the two outer ends of the core tube body 31 by bolts respectively (not shown).

The heat exchange copper tube 34 wound around the core tube body 31 and the outer wall of the core tube body 31 is provided between the inner wall of the core tube body 31 with two parallel joints 341, 342 connected to its both ends in which the parallel joint 341 is passing through the hole 212 in the front enclosed plate 21 and bonded integrally with it by sealing gel, while the other joint 342 is passing through the hole 221 in the rear enclosed plate 22, and bonded with it by sealing gel. The distance between the outer wall of the copper tube 34 and the inner wall of the outer casing 1, as well as the outer wall of the core tube body 31 is 3~5 mm, the diameter of the copper tube 34 is 5~10 mm, and the outer surface of the copper tube 24 is coated with isolating paint.

Referring to FIG. 1, there is provided one or more heat exchanging copper tubes 34. When there is one copper tube 34 the parallel joints 341, 342 and the copper tube 34 are connected to form an integral structure.

Figure 7:
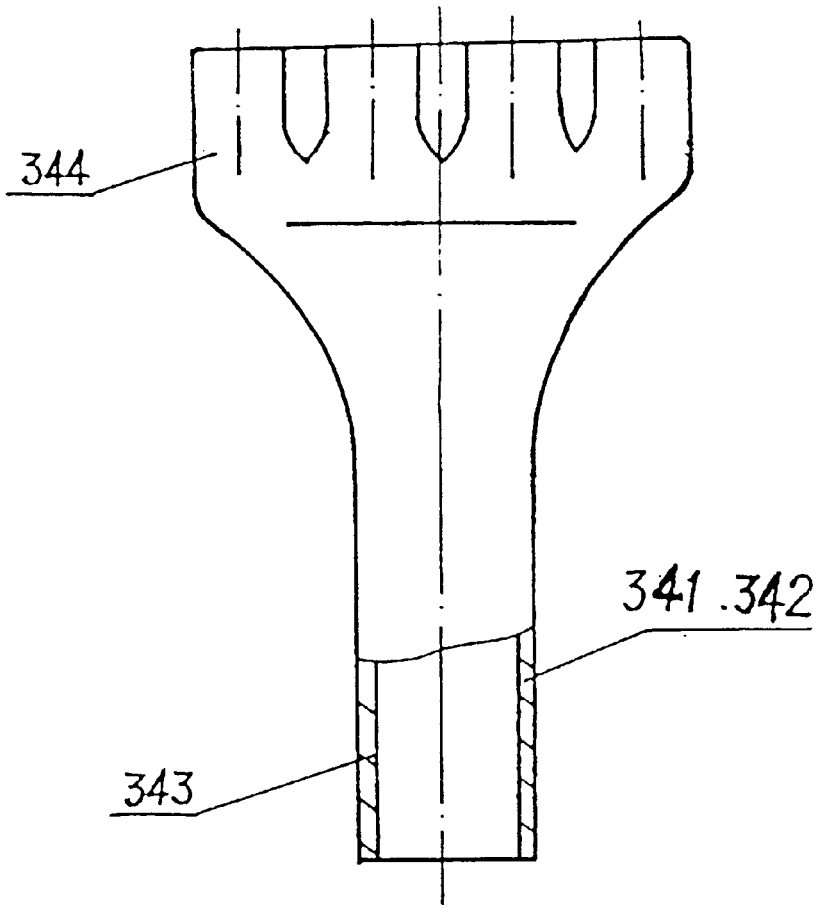
FIG. 7 is the schematically front view of the structure of the parellel joint of the invention.
Figure 8:
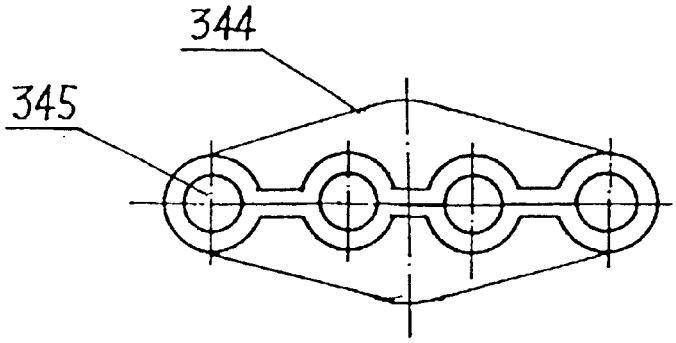
FIG. 8 is the top view of FIG. 7.

As shown in FIG. 7 and FIG. 8, if there are a plurality of copper tubes 34, for example, the thin copper tubes (Φ5~10 mm) wound in parallel constituting an assembly of heat exchanging copper tubes as in present enbodiment, the parallel joints 341, 342 are designed with one end of circular tube body 343 fitted with the circular holes 212, 221 respectively; and the other end of a flat tube body 344 soldered with the circular tube body 343 integrally. The flat tube body 344 is divided into a plurality of circular holes 345 within which a number of heat exchanging copper tubes are inserted forming an assembly of heat exchanging copper tube.

The above mentioned flow guide plate 4 provided between the inner wall of the outer casing 1 and the outer wall of the core tube body 31 is located between the adjacent two copper tubes 34. The adjacent two flow guide plate 4 are arranged in opposite directions (not shown) and the inner annular surface of the flow guide plate 4 contacts the core tube body 31 while its outer annular surface contacts the inner surface of the lower outer casing 11 and the upper outer casing of the outer casing 1.

As shown in FIG. 1 and FIG. 5, the shape of the flow guide plate 4 is corresponding to that of the half section of the outer casing 1, i.e. the semicircular shape in the embodiment FIG. 5. At the inner hole of the flow guide plate 4 a positioning slot 41 is formed with which the flow guide plate 4 is held on the positioning ridge 32 (FIG. 6) to form an integral piece. The outer annular surface of the flow guide plate 4 contacts the inner surface of the outer casing 1 and its inner annular surface contacts the outer surface of the core tube body 31.

The sealing means includes the fastening bolts 51, nuts 52 and sealing pads 53 sandwiched between the lower outer casing 11 and the upper casing 12. The fastening bolts 51 are inserted into the through holes in the lid 111 the lower outer casing 11 and in the lid 123 of the upper outer casing 12, and then fixed by the nuts 52 to be sealingly connected together forming a complete outer casing 1.

As shown in FIG. 1, when the invention is actuated the exhausted hot water enters the heat exchanger from the inlet of thermal medium 122 in the direction $R_{in}$, and then makes complex flow forward to the left under the influence of the flow guide plate 4 along the inner chamber of the outer casing 1.

At the same time of flowing of the exhausted hot water it reduces temperature through the heat exchanging copper tube 34, and finally exits the outlet of thermal medium 211 in the direction of $R_{out}$. The clean tap water enters the heat exchanger from the parallel joint 341 on the left side of the core type device 3 in direction $L_{in}$, and then makes complex flow to the right along the inner surface of the copper tube 34 absorpting the heat from the copper tube 34 exerted by the exhausted hot water, thus increasing its temperature. Tap water with increased temperature exits the parallel joint 342 on the right side in direction $L_{out}$. Since the cold water and hot water flow in opposite directions, therefore the temperature difference of the heat transfer is low, heat conduction is fast and the efficiency of heat exchange is high. The application experiment and test show that if the temperature of the exhausted hot water is 37° C.~38° C., with equal flow rate of the cold and hot water, then the temperature of the cold tap water after heat exchange with the exhausted hot water can reach 33° C.~34° C. from its cold water level, i.e. become hot water, thus providing significant energy saving, especially in winter.

Figure 9:
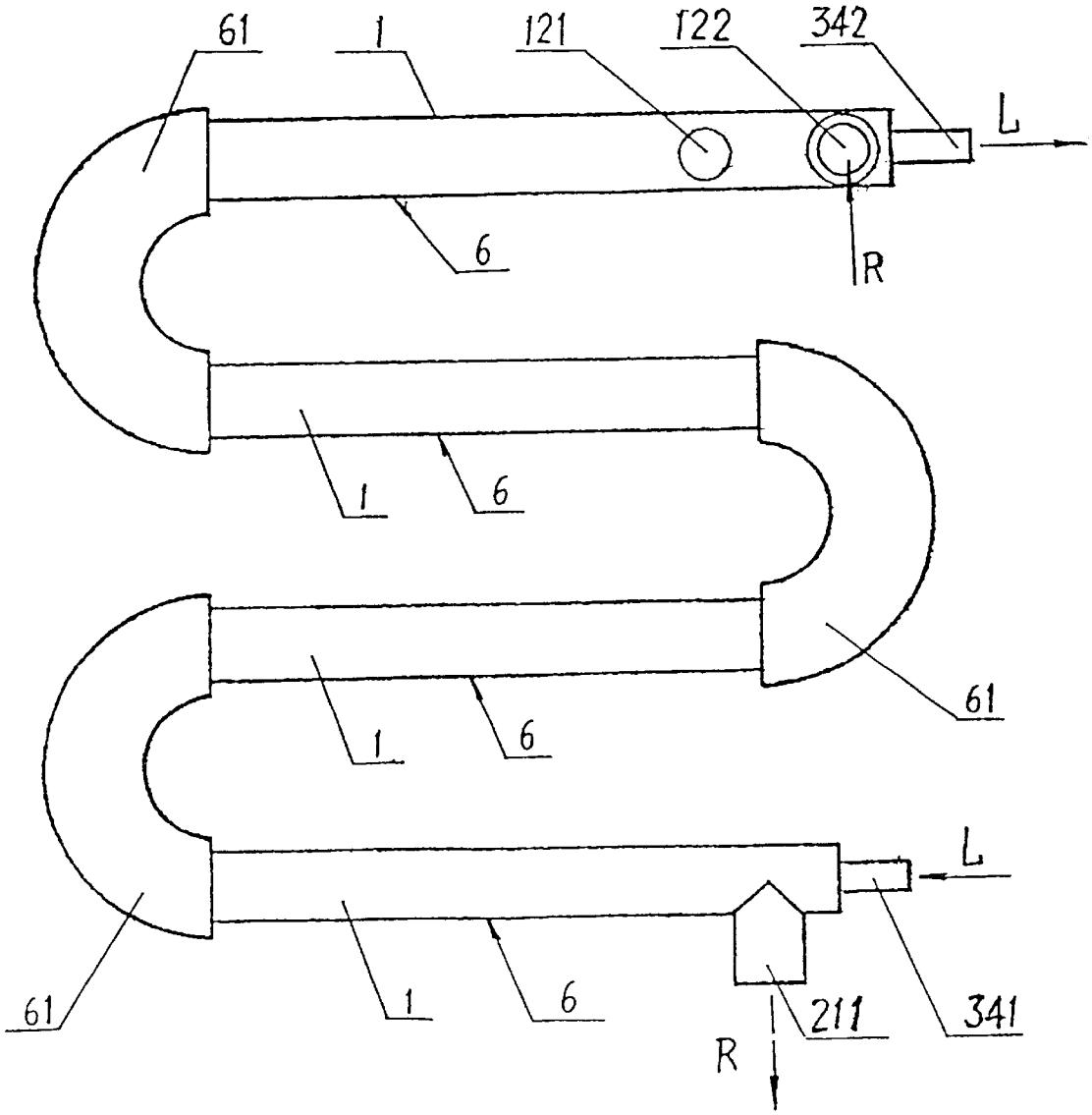
FIG. 9 is the schematic view of the structure of the second embodiment of the invention.

Referring to FIG. 9 showing the second embodiment of the assembling heat exchanger of spiral sleeve of the invention where the enclosed plate 2, core tube body 31, heat exchanging copper tube 34 and the flow guide plate 4 are identical in structure with the first embodiment (FIG. 1, FIG. 2, FIG. 5, FIG. 6), therefore their structure have been omitted in FIG. 9 and there is no need of their discription. The difference is that there are at least more than two heat exchange units of spiral sleeve 6 elbows to form an integral tubular net structure. The heat exchange unit of spiral sleeve 6 consists of the outer casing 1, core tube body 31, heat exchanging copper tube and flow guide plate 4 (refer to FIG. 1). The outer casing 1 is designed as a circular tube of certain length with connection elbow 61 at its end which in turn is provided between the rear end of the first outer casing 1 and the head end of the next outer casing 1, thus jointing a plurality of heat exchange units of spiral sleeve 6 to form an integral tubular net structure. As shown in FIG. 1 and FIG. 9, the front plate 21 and the rear plate 22 of the enclosed plate 2 are provided on the first input end and the last output end of the whole tubular net structure only, and bonded to the outer casing 1 by means of adhesive. The vent port 121 and the inlet of the thermal medium 122 are provided on the first outer casing 1 of the tubular net structure by injection moulding, and at the end of the first outer casing 1 also the parallel joint 342 is available while the outlet of thermal medium 211 is provided on the last outer casing 1, and at its end the parallel joint 341 is available.

When the invention is actuated the exhausted hot water enters the heat exchanger from the inlet of thermal medium 122 of the first outer casing 1 in direction $R_{in}$, and then makes complex flow toward the and of the outer casing 1, along the channel of the inner channel of the outer casing 1, and finally exit the outlet of the thermal medium 211 at the last outer casing 1 in direction $R_{out}$. The clean tap water enters the heat exchanger from the parallel joint 341 on the last outer casing 1 in direction $L_{in}$, and then makes complex flow to the right along the inner wall of the heat exchanging copper tube 34 absorpting the heat from the copper tube 34 exerted by the exhausted hot water and becoming hot water. The hot water after increasing temperature from cold state exits the parallel joint 342 of the first outer casing 1 in direction $L_{out}$.

Figure 10:
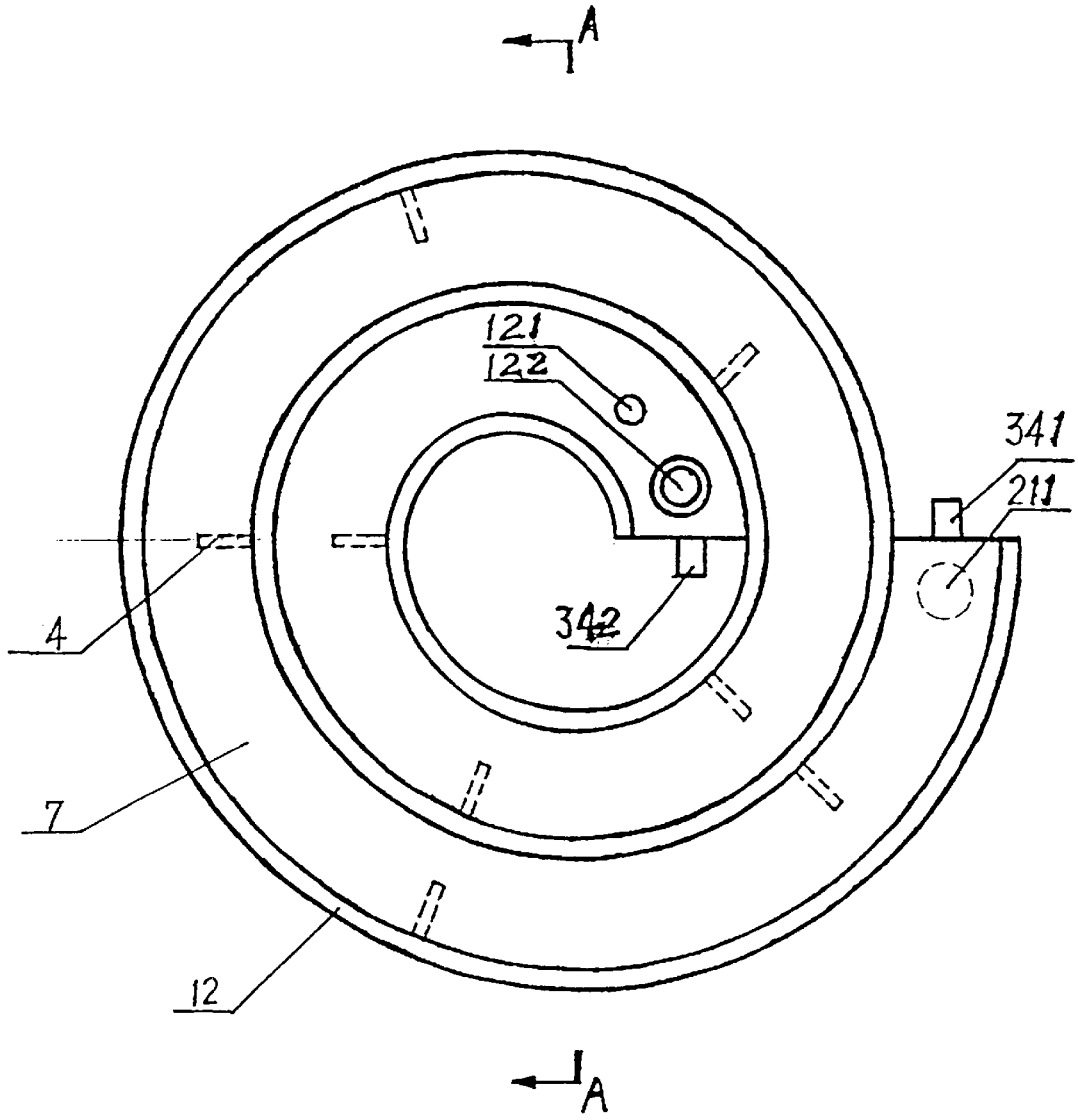
FIG. 10 is the schematic view of the structure of the third embodiment of the invention.
Figure 11:
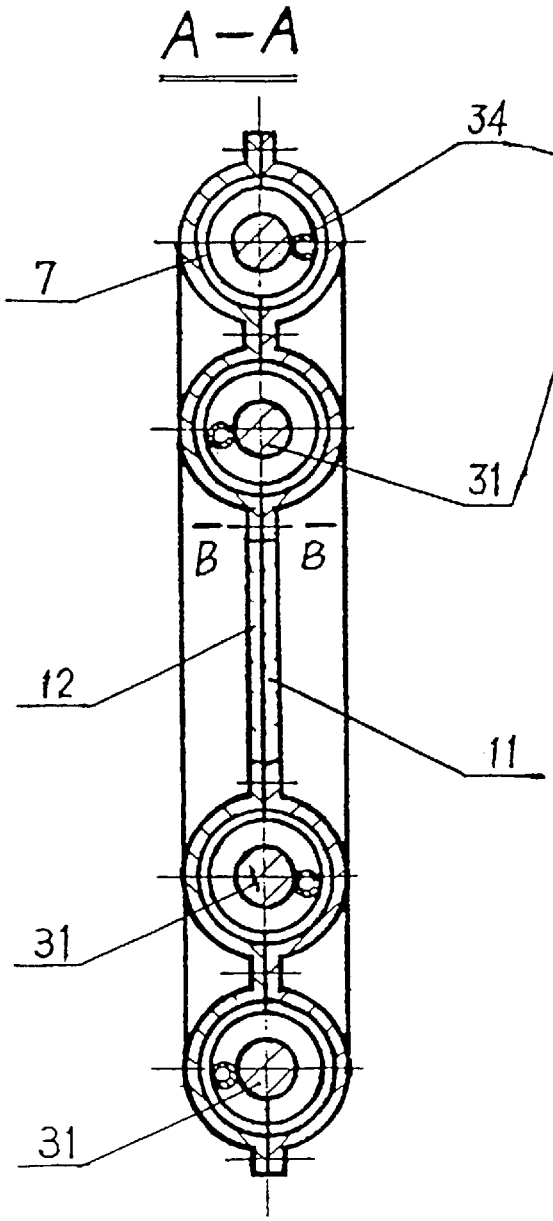
FIG. 11 is the schematic view of the structure of the section taken along A—A line in FIG. 10.
Figure 12:
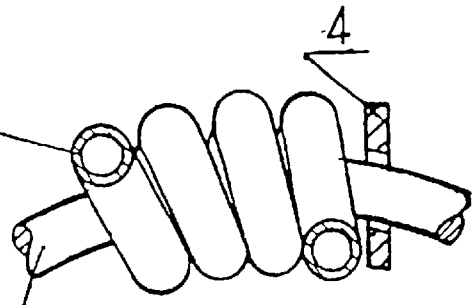
FIG. 12 is the partially enlarged schematic view of the structure of the copper tube and flow guide plate in FIG. 11.
Figure 13:
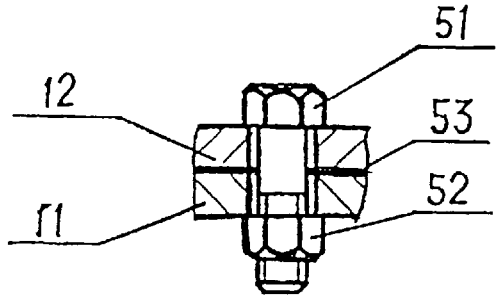
FIG. 13 is the schematic view of the structure of the section taken along B—B line in FIG. 11.

Now reference is made to the FIGS. 10, 11, 12 and 13 showing the third embodiment of the assembling heat exchanger of spiral sleeve of the invention which is composed of a spiral lower outer casing 11, upper outer casing 12, enclosed plate 2, core tube body 31, heat exchanging copper tube 34 and flow guide plate 4. As shown in FIGS. 1, 5 and 6, the enclosed plate 2, core tube body 31, heat exchanging copper tube 34 and the flow guide plate 4 have identical structure as that of the first embodiment, and the front plate 21, rear plate 22 of the enclosed plate 2, end plate 33 of the core tube body 31, parallel joints 341, 342 of the copper tube 34 also identical in structure with the first embodiment, therefore their discription is omitted herein. The difference is that in this embodiment a sealing pad 53 is provided between the spiral lower outer casing 11 and the upper outer casing 12, then fastened by the bolts 51 and nuts 52 to form a spiral channel 7 of circular section (FIG. 10, FIG. 11). Inside the spiral channel 7 the core tube body 31 is provided around which one of more thin copper tube 34 of 5~10 mm in diameter are wound. On both ends of the copper tube 34 the parallel joints 341, 342 are provided (FIG. 10) and between the adjacent two copper tube 34 a semiannular flow guide plate 4 is placed. The adjacent two flow guide plates 4 are placed in opposite directions.

On the upper outer casing 12, a vent port 121 and the inlet of thermal medium 12 are available, which are integrated with the upper outer casing 12 by injection moulding. An integrally spiral channel 7 of semicircular section is formed in the lower outer casing 11 and upper outer casing 12 by injection moulding.

As shown in FIG. 1, the core tube body 31 of the core tube device 3 is a spiral tube with the end enclosed plates 33 on both ends which are then bonded to both ends of the core tube body 31 forming an integral core device 3.

Figure 14:
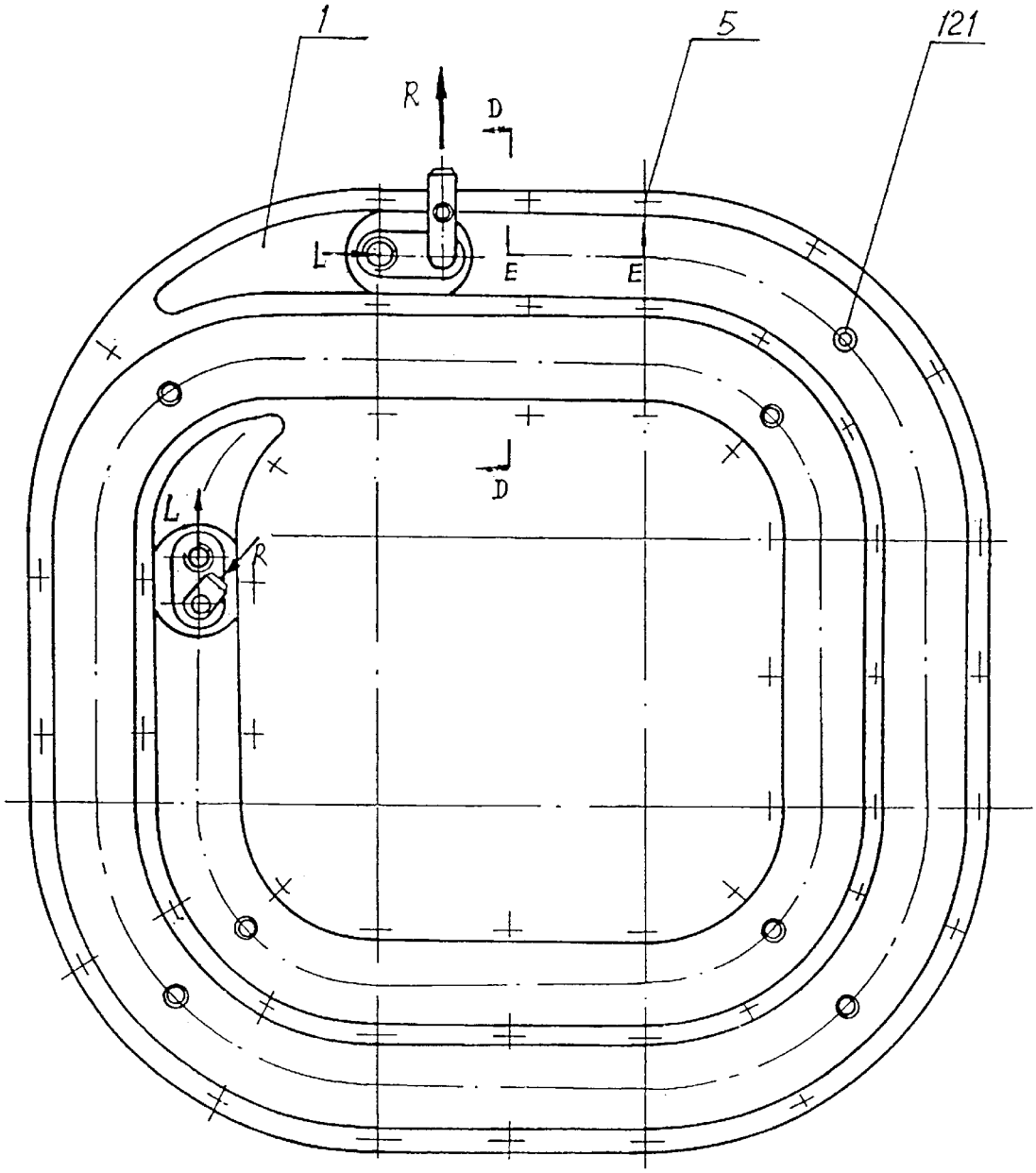
FIG. 14 is the schematic view of the structure of the forth embodiment of the invention.
Figure 15:
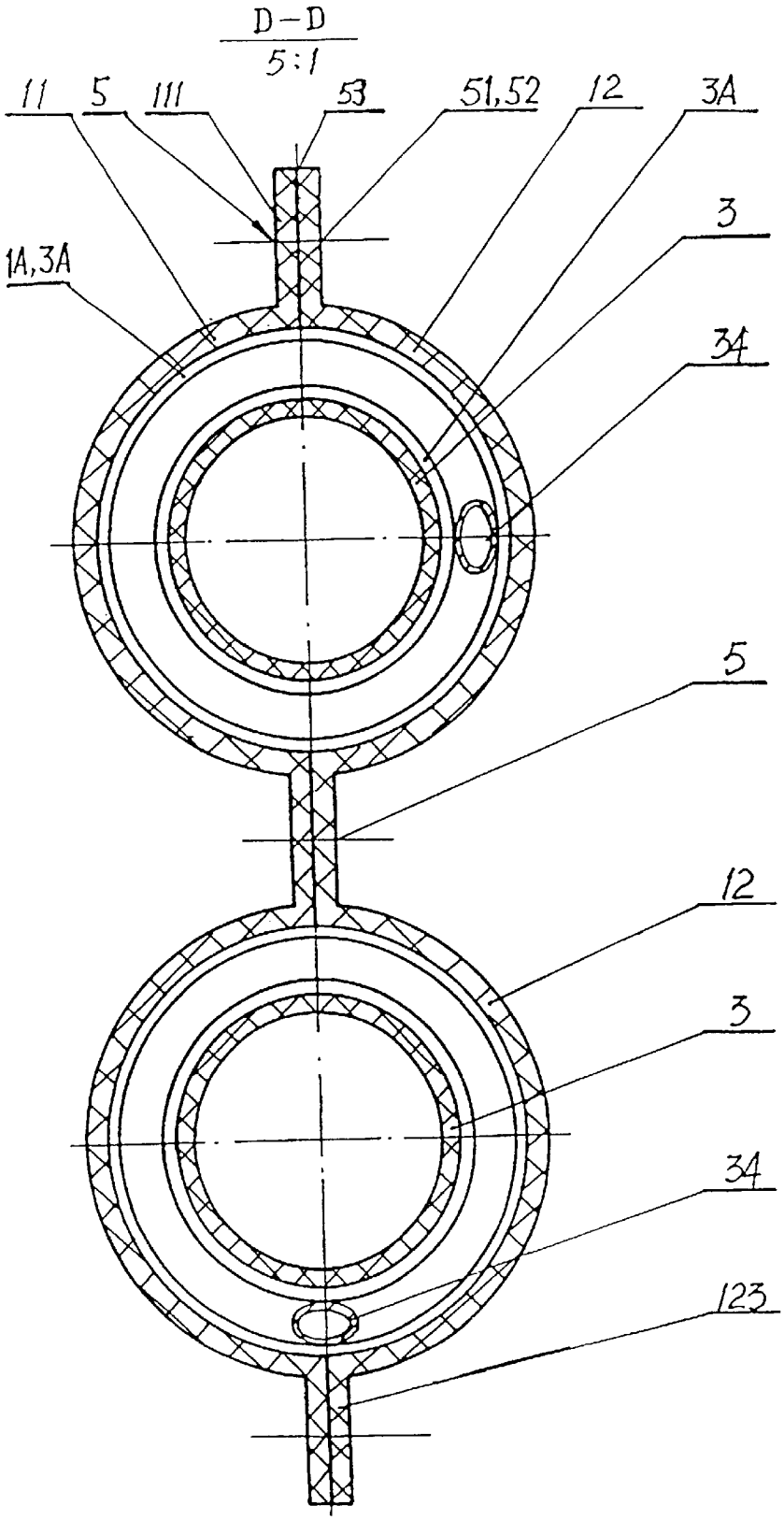
FIG. 15 is the partially enlarged schematic view of the structure of the section taken along D—D line in FIG. 14.
Figure 16:
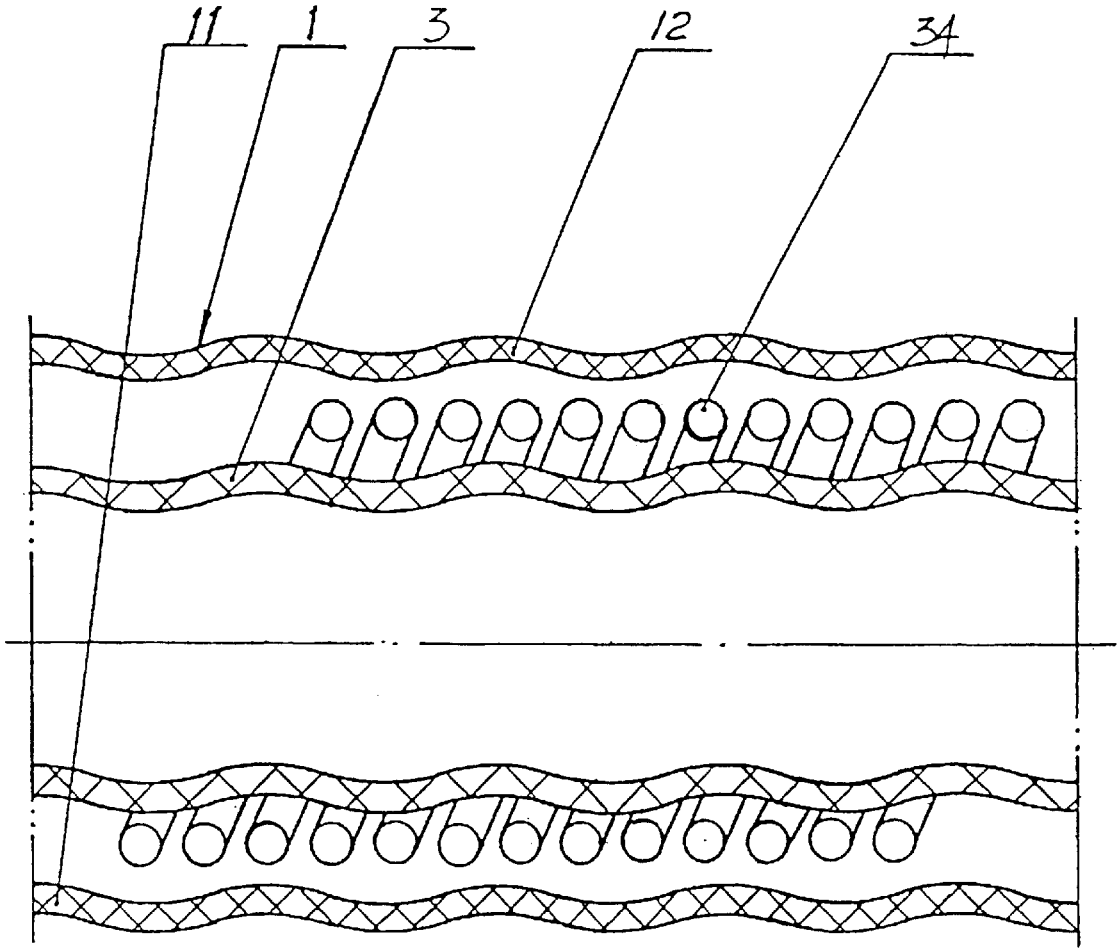
FIG. 16 is the partially enlarged schematic view of the structure of the section taken along E—E line in FIG. 14.

In FIGS. 14, 15 and 16 the four embodiment of the assembling heat exchanger of spiral sleeve is shown which consists of the casing 1, core tube body 3, heat exchanging copper tube 34 and flow guide plate 4. The shapes of the cross section of the outer casing 1 and the core tube body 3, as well as the structure of the copper tube and the flow guide plate 4 are the same as that of the third embodiment, thus their discripion is omitted. The difference is that there is no need for the spiral outer casing 1 to provide the end enclosed plate 2 (FIG. 14), instead a sealing means 5 is placed between the spiral lower outer casing 11 and the upper one 12 which are then fixed by a plurality of bolts 51 to form an integral outer casing with an interior sealed spiral channel 1A. The longitudinal sections of the outer casing 1, core tube body 3 and heat exchanging copper tube 34 are made as waveform (FIG. 16) wherein:

The above outer casing 1 includes the lower outer casing 11 and the upper outer casing 12, in which:

The cross section of the lower outer casing 11 is formed of semicircular downward concave shape (FIG. 15) and the longitudinal section of waveform (FIG. 16). The highness between the peak and valley of the wave is 1~5 mm, the distance between the peaks or valleies is 20~60 mm.

The cross section of the upper outer casing 12 is formed of semicircular upward concave shape (FIG. 15), and the longitudinal section of waveform (FIG. 16). Te highness between the peak and valley of the wave is 1~5 mm, and the distance between the peaks or valleies is 20~60 mm. The vent port 121 is formed on top of the upper outer casing 12 (FIG. 14). The inlet of the thermal medium $R_{in}$ and the outlet thereof $R_{out}$, as wall as the inlet $L_{in}$, and outlet $L_{out}$ of the cold water formed by the parallel joints are provided on the top portion of the head end of the interior ring of the upper outer casing 12 and on the top portion of the rear end of the exterior ring of the same respectively.

The above core tube body 3 is a hollows tube with circle shaped cross section and waveform shaped longitudinal section. The highness between the peak and the valley of the wave is 1~5 mm, the wave length is 20~60 mm.

As shown in FIGS. 4 and 15, the above sealing means comprises the fastening bolts 51, nuts 52 and sealing pad 53 sandwiches between the lower outer casing 11 and the upper one. The fastening bolts 51 are inserted through the holes on the lid 111 of the lower outer casing 11 and the lid 123 on the upper outer casing 12 to joint the above lower and upper outer casings into a complete outer casing 1 by nuts 52. In the embodiment a circular sealed spiral in section channel 1A is formed inside the outer casing 1.

The embodiment of the above structure has significant advantages and effect. When fluid is flowing within the annular sealed spiral channel 3A provided between the inner wall of the waveform shaped outer casing 1 and the outer wall of the core type body 3, the strong pertubation is created which even in the case of low flow velocity causes fuel turbulence of the fluid. Experiments show that under the same condition the heat exchange temperature of the fluid flowing inside the waveform shaped casing is higher than that of the fluid flowing in general tube as in the existing art by 1° C.~3° C., i.e. the coefficient of heat exchange of the embodiment is higher than that of the present product thus having high heat exchange efficiency.

Furthermore, the outer casing 1 and the core tube body 3 of the spiral heat exchanger according to the embodiment are waveform shaped, and also a waveform shaped annular sealed channel 3A is formed there between which calluses full turbulence of the fluid flowing inside the channel, and can also flush the tube surface, thus making impossible formation of scales on the inner wall of the outer casing 1 and the outer wall of the core tube body 3 with the effect of ensuring high heat exchange efficiency and reducing maintenance.

From the above embodiments it is clear that the structure of the heat exchanger of spiral sleeve according to the invention is new and posses wide applications in the case of recovery the heat remainder of hot water. For example, it can be combined with the gas water heater forming a gas water heater of energy saving type which can save energy more than 50% annually. Also it can be combined with the electric water heater (rated power 240 w, tank volume 5L.) forming the quasi-instant electric water heater. Alternatively it can be used in the integral bath room forming the water heating device of the integral bath room with energy saving. The exhausted hot water can also be used to preheat the water supply of the boiler thus significantly saving energy. It can also be in many other cases of recovery of heat remainder.

The above discription is referred to the preferred embodiments of the invention but is not the limitation of the invention. All the simple modifications of changes according to the art of the invention are within the scope of the invention.

Industrial Applibility

The invention has obvious advantages and active effects over the existing art. From the above it can be seen, that the invention can fully recover the heat remainder of the bathing waste water from families or public sites as well as other exhausted hot water with high efficiency of heat exchange ($\eta \geqq 0.9$) significantly increasing the temperature of the tap water of the amount equal to that of the exhausted hot water. Assuming the temperature of the tap water in winter is 7° C., the temperature of the bathing waste water is 37° C., then with the heat exchanger of the invention the temperature of tap water of the amount equal to that of the exhausted hot water can reach 33° C. demonstrating the obvious effect of recovery of the heat remainder, energy saving and cost reduction. In addition, it is compact in structure, easy to manufacturing, assembling, detaching and cleaning.

The heat exchanger spiral sleeve of the invention posses wide applications in the case of recovery the heat remainder of hot water. For example, it can be combined with the gas water heater forming a gas water heater of energy saving type which can save energy more than 50% annually. Also it can be combined with the electric water heater (rated power 240 w, tank volume 5L.) forming the quasi-instant electric water heater, alternatively it can be used in the integral bath room forming the water heating device of the integral bath room with energy saving. The exhausted hot water can also be used to preheat the water supply of the boiler thus significantly saving energy. It can also be in many other cases of recovery of heat remainder.

From the above it can be seen that the invention can fully recover the heat remainder of exhausted hot water, save energy with compact structure, easiness of manufacturing and cleaning having significant structure and functional improvements, therefore constributing a new, practical design adapted to application.

What is claimed is:

1. A heat exchanger mainly consists of an outer casing, a front enclosed plate and a rear enclosed plate, a core tube device, a flow guide plate and a sealing means, characterized in that the outer casing is a casing structure combining a lower and an upper outer casing; in which:

the lower outer casing is a downwardly concave casing and has lids provided on two sides, and the sealing is means provided between the lower and upper outer casings which are then sealed and formed into the outer casing;

the upper outer casing is an upward by concave casing and has lids on two sides and fasteners inserted through the lids to join the upper and lower outer casings into the outer casing; furthermore, a vent port and an inlet for thermal medium are formed on the top of the upper outer casing;

the front enclosed plate is provided at the front end of the outer casing with an outlet for thermal medium provided on the upper portion of the center line extending outward and a first circular hole for a first parallel joint at the upper portion of the front enclosed plate;

the rear enclosed plate is provided at the rear end of the outer casing and sealed with it, also a second circular hole for a second parallel joint is provided on the lower portion of its center line;

the core tube device has its core tube body formed as a hollow tube and positioning ridges provided on the outer surface, also a heat exchanging copper tube wound around it; the semiannular flow guide plate is placed between adjacent turns of copper tube, the section shape of the core tube body corresponds to that of the outer casing;

end enclosed plates are fixed to the edges of two inner holes of the core tube body respectively;

the heat exchanging copper tube is wound between the inner wall of the outer casing and the outer wall of the core tube body with the first and second parallel joints provided on both ends in which one parallel joint sealingly fixed with the hole in the front enclosed plate and the other with the hole in the rear enclosed plate;

the flow guide plate provided between two adjacent heat exchanging copper tubes which are positioned in opposite directions are shaped in correspondence with the half section shape of the outer casing; and a sealing pad of the sealing means is sandwiched between the lower and upper outer casing which are then secured and sealed to form a complete sealed outer casing by inserting the fastening bolts into the lids of the lower and upper outer casing and attaching nuts.

2. The heat exchanger according to claim 1, characterized in that the section shape of the lower outer casing may be semicircular concave, semirectangular concave or a combination of both;

the vent port and the inlet of the thermal medium provided on top of the upper outer casing may be formed integral with the upper outer casing, or as separate elements which are then integrated with the upper outer casing;

the outlet of the thermal medium provided on the front enclosed plate may be formed integral with the front plate or as separate elements which are then integrated with it;

the rear enclosed plate is bonded integrally with the lower and upper outer casings by an adhesive;

the section shape of the core tube body may be circular, rectangular or a combination of both;

the end enclosed plates are fixed with the edges of two inner holes of the core tube body by an adhesive; and the heat exchanging copper tube is coated with isolating paint on the outer surface.

3. The heat exchanger according to claim 2 is characterized in that there are one or more heat exchanging copper tubes; and the flow guide plate with the semicircle section has a positioning slot provided on the side of the inner hole by means of which the flow guide plate is secured on the positioning ridges of the core tube body integrally;

provided that when there is only one heat exchanging copper tube, the parallel joints are integrated with the heat exchanging copper tube;

and further provided that when there are a plurality of heat exchanging copper tubes, the heat exchanging copper tubes are wound in parallel to form an assembly the parallel joints are designed with an end of a circular tube fitted with the hole of the outer casing and the other end of a flat tube welded integrally with the circular tube, and the flat tube is divided into a number of circular holes into which the heat exchanging copper tubes are inserted.

4. The heat exchanger according to claim 3 characterized in that the vent port on top of the upper outer casing is a 6~8 mm circular hole in diameter, and the inlet of the thermal medium is a 25~40 mm circular hole in diameter; the lower and upper outer casings are made of engineering plastics;

the outlet of the thermal medium provided in the front enclosed plate is a 25~40 mm circular hole in diameter with the diameter of the hole for parallel joint on the upper side equals to the diameter of the parallel joint which are snap fitted;

the end enclosed plates can be designed as the outer cover plate secured to outer sides of two ends of the core tube body by bolts; and the heat exchanging copper tube is a thin copper tube with a diameter of 5~10 mm, the thickness of the outer casing as well as the wall of the core tube body is 3~5 mm.

5. The heat exchanger according to claim 1 characterized in that the outer casing possesses at least more than two heat exchange units of spiral sleeves connected by elbows into an integral tubular net structure.

6. The heat exchanger according to claim 5 is characterized in that the heat exchange unit consisting of the outer casing, core tube body, the heat exchanging copper tube and the flow guide plate with the outer casing as a circular tube of certain length has the connecting elbows on the end portions which are positioned between the rear end of the outer casing and the heat end of the next outer casing jointing a number of heat exchange units of spiral sleeves into an integral tubular net structure;

the front and rear enclosed plates of the core tube device are provided only on the first inlet end and the last outer end of the whole tubular net structure and are connected with the outer casing integrally; and the vent port and the inlet of the thermal medium are provided on the first outer casing of the tubular net structure with the parallel joint on the end portion, and the outlet of the thermal medium is provided on the last outer casing with the parallel joint on the end portion.

* * * * *